106-18.14 SR

XR 3,974,251

United States

Cremer et al.

11] 3,974,251

45] Aug. 10, 1976

[54] PRODUCTION OF FLAMEPROOF FIBERS OF REGENERATED CELLULOSE

[75] Inventors: Joseph Cremer, Hermulheim; Heinz Harnisch, Lovenich, both of Germany; Johannes Adolf Krässig; Johannes Hüpfl, both of Seewalchen, Austria; Werner Gschaider, Vocklabruck, Austria

[73] Assignees: Hoechst Aktiengesellschaft, Cologne, Germany; Chemiefaser Lenzing Aktiengesellschaft, Lenzing, Austria

[22] Filed: Mar. 4, 1974

[21] Appl. No.: 447,756

[30] Foreign Application Priority Data

Mar. 7, 1973 Germany ..... 2311180

[52] U.S. Cl. ..... 264/194; 106/15 FP; 106/165; 106/177; 264/191

[51] Int. Cl.[2] ..... D01F 2/08

[58] Field of Search ..... 264/194, 191; 106/15 FP, 165, 177; 423/302; 260/45.9 NP

[56] References Cited

UNITED STATES PATENTS

| | | | |
|---|---|---|---|
| 2,648,597 | 8/1953 | Nielsen | 106/15 FP |
| 3,266,918 | 8/1966 | Schappel et al. | 106/15 FP |
| 3,323,944 | 6/1967 | Senez | 106/15 FP |
| 3,387,980 | 6/1968 | Trainor et al. | 106/15 FP |
| 3,455,713 | 7/1969 | Godfrey | 106/165 |

*Primary Examiner*—Jay H. Woo
*Attorney, Agent, or Firm*—Connolly and Hutz

[57] ABSTRACT

Flame-retardant fibers of regenerated cellulose are produced by adding one or more flame-retardant phosphorus compounds to the viscose, extruding the viscose into a spinning bath and, if desired, stretching and after-treating the resulting filaments or staple fibers. The flame-retardant agent is a compound of the general formula $$PN_xO_y$$

in which $x$ stands for a number between 0.9 and 1.7 and $y$ stands for a number between 1.2 and 0, where the $y$-values converge towards zero as the $x$-values increase. The flame-retardant agent is more particularly used in a proportion approximately between 5 and 30 weight %, based on the weight of the cellulose.

5 Claims, No Drawings

3974251
OR IN 264/194

PRODUCTION OF FLAMEPROOF FIBERS OF REGENERATED CELLULOSE

The present invention relates to the production of flame-retardant regenerated cellulose fibres by adding one or more flame-retardant phosphorus compounds to viscose, extruding the viscose containing mixture thus obtained into a spinning bath and, if desired, stretching and after-treating the resulting filaments or staple fibres.

Various processes for making flame-retardant regenerated cellulose fibres have already been described, wherein various flame-retardant agents are added to the viscose, prior to extruding it. Halogen-containing phosphoric acid esters, e.g. tris-(2,3-dibromopropyl)-phosphate, have more particularly been used as the flame-retardant agents (cf. U.S. Pat. No. 3,266,918, British patent specification No. 1,158,231 and French Pat. Nos. 1,495,909 and 1,599,000). These halogen-containing phosphoric acid esters are, however, not entirely suitable for use in the viscose spinning process, in view of their chemical reactivity with the other constituents of the viscose containing mixture, and in view of the fact that they are used in the liquid state. More particularly, the above-mentioned compounds are hydrolyzable in alkaline media, in which they undergo partial decomposition and are deprived of their flame-retardant properties. They have also been found to react with carbon disulphide, which is present in the viscose, with the resultant formation of strongly coloured by-products which impair the external appearance of the resulting fibres and which are difficult to bleach away. These compounds are generally incorporated in the fibres only fractionally, as a result of their being used in the liquid state. Considerable proportions of the flame-retardant agents or the decomposition products thereof go into the coagulating bath or after-treatment baths, which are used in viscose spinning, where they initiate a series of disadvantageous effects, such as increased corrosiveness, unpleasant smell and similar phenomena.

Further known flame-retardant agents which can be added to regenerated cellulose fibres include phosphonitrile chloride derivatives and phosphonitrilate polymers. The use of these compounds has been described, for example in U.S. Pat. No. 3,455,713 and Austrian Pat. No. 269,338, respectively. These latter compounds have an improved stability to viscose and compare favourably in this property with the halogen-containing phosphoric acid esters first referred to hereinabove. In addition to this, they have been found to affect the fibres' appearance less adversely. Despite this, they are again not fully satisfactory because considerable portions of the compounds go into the coagulating baths, where they are lost, which does not make for economy.

German published specification ("Offenlegungsschrift") No. 1,944,056 describes a process comprising spinning red phosphorus into viscose fibres. In this case, it is possible for red phosphorus to be spun into the fibres practically quantitatively, generally without any adverse effects on the fibre production process. The resulting fibres, however, are dark violet and admit of only limited uses in the textile field.

In accordance with the present invention, we now provide a process which is free from the disadvantages and difficulties referred to hereinabove and which comprises producing flame-retardant regenerated cellulose fibres with the use of one or more flame-retardant phosphorus compounds, which:

a. produce reliable flame-retardant effects, even in minor proportions,
b. are not limited to use in a particular viscose spinning process, but can be utilised in a variety of modified processes, whether the modifications affect the nature of the viscose or the spinning procedure,
c. have a satisfactory resistance to alkalies and acids, and
d. combine water-solubility with good dispersibility in the viscose.

It is also highly desirable to have fibres which retain their flame-retardant property after repeated washings, which are easy to dye, and of which the appearance remains unimpaired under ultraviolet light.

These objects can be achieved in accordance with the present invention, which provides a process for making flame-retardant regenerated cellulose fibres by adding one or more flame-retardant phosphorus compounds to viscose, extruding the viscose containing mixture thus obtained into a spinning bath and, if desired, stretching and after-treating the resulting filaments or staple fibres, wherein the flame-retardant phosphorus compound(s) used comprise(s) one or more compounds of the general formula:

$$PN_xO_y$$

in which $x$ stands for a number between 0.9 and 1.7 and $y$ stands for a number between 1.2 and 0, preferably approaching zero as the values of $x$ increase towards 1.7, the flame-retardant compound(s) being used in an approximate proportion between 5 and 30 weight %, based on the weight of the cellulose. The lower and zero values of $y$ tend to be associated with the higher values of $x$, viz. 1.0 to 1.7.

Thus the preferred flame-retardant compounds include: phosphorus nitride, triphosphorus pentanitride, tetraphosphorus hexanitride, phosphorus nitride oxide. It is advisable that the compound(s) used in accordance with the present invention should be solid; thus once they are in pulverulent form, it is possible for them to be dispersed in the viscose or to be spun into the fibres, similarly to titanium dioxide or coloured pigments. The compounds are completely inert with respect to the viscose and the bath used in the viscose spinning process. In clear contrast with some dyestuffs, they could not be found to "bleed out" from the fibres. In other words, they can be incorporated into the fibres substantially quantitatively. In this manner, it is possible for the spinning and after-treatment baths to be kept free from secondary contaminants, and for the fibres to be made under commercially more attractive conditions, without any significant loss of flame-retardant compound(s).

The flame-retardant compounds used in accordance with the present invention have a very good thermal stability, which avoids the need to reduce the spinning bath temperature as is often necessary if use is made of the flame-retardant agents first referred to hereinabove. In the process of the present invention it is possible for the temperature of the spinning bath to be selected and optimized in accordance with the relevant requirements, irrespective of the precise nature of the particular flame-retardant compound(s) used. It should be added that the flame-retardant compounds used in accordance with the present invention also have very good chemical stability and hence a good stability to washing, bleaching and dry-cleaning.

Some of the phosphorus nitrides which may be used in accordance with the present invention have a slight pink coloration which, however, is generally acceptable. In those cases, however, in which it is desirable to use a strictly colourless flame-retardant compound, use may conveniently be made of triphosphorus pentanitride ($P_3N_5$) or phosphorus nitride oxide (PNO), which have already been mentioned above.

Between 8 and 15 weight %, based on the weight of cellulose, of the flame-retardant compound(s) should preferably be added to the viscose. In accordance with the invention, it is also advantageous for the flame-retardant compound(s) to be suspended or dissolved in a liquid compatible with the viscose, which may for instance be water, sodium hydroxide solution or another liquid miscible with aqueous media, e.g. an inert organic liquid, and for the resulting suspension or solution to be added to the viscose.

Needless to say, the present flame-retardant compounds, once they have been incorporated in the substance of the fibres, influence the properties of the fibres to some extent, though not, however, more than mass-dyeing with coloured pigments. In other words, use can be made of the present process for making high-grade viscose fibres. By varying inter alia the composition of the viscose and that of the coagulating bath, it is possible to produce fibres of widely different properties, e.g. high strength fibres or crimped fibres, for a plurality of uses in the textile field. Delustering agents or coloured pigments may additionally be incorporated into the fibres. Depending on the uses the fibres are put so, use can be made of any known viscose spinning method for making the flame-retardant regenerated cellulose fibres of the present invention.

In those cases in which the so-called "mass-dyeing" technique is employed, it is possible for the process of the present invention to be carried out with simple technical means, for example in the following manner: The flame-retardant compound or compounds, ground to particles having a preferred size approximately of 2 microns, is or are suspended in water or in an inert organic solvent, and the resulting suspension is metered, in quantities constant in unit time, upstream of the spinnerets, into the viscose, and very finely distributed therein by means of homogenizers. The composition of the viscose can be modified, depending upon the fibre properties aimed at. The viscose should preferably contain between 6 and 9 weight % of cellulose, and between 3 and 6 weight % of NaOH and between 33 and 38 weight % of carbon disulphide, based on cellulose. To facilitate spinning and to modify the properties of the fibres, use can be made of various modifying agents including ethoxylated fatty acid esters, ethoxylated amines or ethoxylated phenols.

The viscose can be extruded through spinnerets into coagulating baths of whatever composition is appropriate having regard to the fibre properties aimed at. In typical case, however, the coagulating baths preferably contain between 70 and 110 g/l of $H_2SO_4$, between 90 and 360 g/l of $Na_2SO_4$, and between 3 and 60 g/l of $ZnSO_4$, and are preferably used at temperatures between 25° and 60°C. The filaments coming from the coagulating bath can be delivered to a second and more dilute spinning bath and stretched therein, or stretched in air. The filaments can then be cut up to form staple fibres, if desired, and can be after-treated with hot dilute sulphuric acid and hot dilute sodium sulphide solution, bleached by means of hypochlorite or hydrogen peroxide, and "revived" or brightened.

The following Examples illustrate the invention.

EXAMPLE 1:

10 weight %, based on the cellulose, of triphosphorus pentanitride ($P_3N_5$) in aqueous suspension was continuously metered into a viscose containing 6 weight % of cellulose, 6 weight % of alkali, 35 weight % of $CS_2$, based on the cellulose, and 3 weight % of a modifying agent, based on the cellulose. The viscose had a viscosity of 75 kgfsec. and a spinning ripeness of 57 gamma units. By means of a homogenizer, the suspension was very finely distributed in the viscose, which was spun at 42°C into a spinning bath containing 70 g/l of $H_2SO_4$, 100 g/l of $Na_2SO_4$, and 60 g/l of $ZnSO_4$. The spinning tow, which had a total titre approaching 200,000 dtex, was drawn at a rate equal to 110 % of its initial length in a second and more dilute spinning bath at 92°C and thereafter cut up in a cutting machine to form staple fibres. The staple fibres were completely regenerated in a series of successive baths with hot dilute sulphuric acid, desulphurised by means of hot dilute sodium sulphide solution, bleached by means of dilute sodium hypochlorite solution and revived or brightened. The fibres were dried, and were found to have the following textile characteristics: Titre: 3.3 dtex; strength of fibre, conditioned and with 11 % moisture: 25.0 p/tex; elongation of fibre, conditioned: 15.8 %; strength of fibre, moist: 16.2 p/tex; elongation of fibre, moist: 17.0 %; loop strength: 7.8 p/tex.

To determine the flame-retardant effect, a fabric which had a superficial density of 300 g/m² was subjected to a vertical burning test (German Industrial Standard Test No. 53906). The following results were obtained:

| | Ignition time 3 sec. | Ignition time 15 sec. |
|---|---|---|
| Burning time in sec. | 0 | 0 |
| Glow time in sec. | 0 | 0 |
| Tear length in cm | 2.3 | 4.8 |

A similar fabric made from non flame-retardant fibre was subjected to a control test, in which the test surface was found to have been completely burned.

EXAMPLE 2

12 weight %, based on the cellulose, of phosphorus nitride oxide (PNO) in aqueous suspension was metered at a constant velocity into a viscose containing 8.4 weight % of cellulose, 5.2 weight % of alkali and 34 weight % of carbon disulphide. The viscose had a viscosity of 52 kgfsec. and a spinning ripeness of 38 gamma units. It was spun into a spinning bath containing 95 g/l of $H_2SO_4$, 350 g/l of $Na_2SO_4$, and 10 g/l of $ZnSO_4$, at 48°C. The spinning tow, which had a total titre approaching 200,000 dtex, was drawn out, in air, by 50 % of its initial length, and was thereafter cut up in a cutting machine to form staple fibres. The staple fibres were completely regenerated in a series of successive baths with dilute sulphuric acid, desulphurised by means of dilute sodium sulphide solution, bleached with the use of dilute sodium hypochlorite solution and revived or brightened. All of these after-treatment baths were maintained at elevated temperature. The fibres were dried, and were found to have the following textile characteristics: Titre: 8.9 dtex; strength of fibre, conditioned: 15.1 p/tex; elongation of fibre, conditioned: 20.4 %.

To determine the flame-retardant effect, a fabric which had a superficial density of 400 g/m² was subjected to the test described in Example 1. The following results were obtained:

| | Ignition time 3 sec. | Ignition time 15 sec. |
|---|---|---|
| Burning time in sec. | 0 | 2 |
| Glow time in sec. | 0 | 1 |
| Tear length in cm | 2.5 | 5.2 |

Each of the fabrics used in Examples 1 and 2, respectively, were washed 50 times at the boiling point with the use of 5 g/l of a commercial detergent. The flame-retardant properties of the fabrics so washed were tested once again in the manner described in Example 1, but could not be found to have been impaired.

We claim:

1. In a process for making flame-retardant regenerated cellulose fibers by adding flame-retardant phosphorus compounds to viscose, extruding the viscose containing mixture so obtained into a spinning bath and, if desired, stretching and after-treating the resulting filaments or staple fibers, the improvement comprising adding as the flame-retardant a compound selected from the group consisting of phosphorus nitride, triphosphorus pentanitride, tetraphosphorus hexanitride and mixtures thereof, the amount of the flame-retardant being approximately 5 – 30% by weight of the cellulose.

2. The process as claimed in claim 1, wherein between about 8 and 15 weight %, based on the weight of cellulose, of the flame-retardant is incorporated into the regenerated cellulose.

3. The process as claimed in claim 1, wherein a suspension or solution of the flame-retardant in a liquid compatible with the viscose is added to the viscose.

4. The process as claimed in claim 3, wherein the viscose-compatible liquid is water, sodium hydroxide solution or another liquid miscible with an aqueous medium.

5. The process as claimed in claim 4, wherein an inert organic liquid is used as the viscose-compatible liquid.

* * * * *